US005083123A

United States Patent [19]

Ganter et al.

[11] Patent Number: 5,083,123

[45] Date of Patent: Jan. 21, 1992

[54] AUTONOMOUS RADIO CONTROLLED TIMEPIECE

[75] Inventors: Wolfgang Ganter, Schramberg; Wolfram Hodapp, Rottweil, both of Fed. Rep. of Germany

[73] Assignee: Junghans Uhren GmbH, Fed. Rep. of Germany

[21] Appl. No.: 598,830

[22] Filed: Oct. 18, 1990

Related U.S. Application Data

[63] Continuation of Ser. No. 248,388, Sep. 23, 1988, abandoned.

[30] Foreign Application Priority Data

Sep. 23, 1987 [DE] Fed. Rep. of Germany ..... 3731956

[51] Int. Cl.[5] ..... G08C 19/00

[52] U.S. Cl. ..... 340/825.57; 368/47

[58] Field of Search ..... 368/10, 11, 47, 69, 368/70, 72, 112, 251, 84; 340/825.57, 825.44; 370/94

[56] References Cited

U.S. PATENT DOCUMENTS

| | | | |
|---|---|---|---|
| 3,795,099 | 3/1974 | Tsuruishi | 368/112 X |
| 3,937,004 | 2/1976 | Natori et al. | 368/11 |
| 4,175,377 | 11/1979 | Ichikawa | 368/84 |
| 4,255,803 | 3/1981 | Sekine | 368/72 |
| 4,301,524 | 11/1981 | Koepp et al. | 368/251 X |
| 4,315,332 | 2/1982 | Sakami et al. | 368/47 X |
| 4,650,344 | 3/1987 | Allgaier et al. . | |

FOREIGN PATENT DOCUMENTS

| | | | |
|---|---|---|---|
| 3015312 | 10/1981 | Fed. Rep. of Germany . | |
| 3439638 | 10/1984 | Fed. Rep. of Germany . | |
| 3510636 | 9/1986 | Fed. Rep. of Germany . | |
| 0090883 | 7/1980 | Japan | 368/47 |
| 0079281 | 6/1981 | Japan | 368/47 |

OTHER PUBLICATIONS

H. Effenberger, Inst. for Timepiece Technology and Precision Mechanics, Stuttgart University, "Microprocessor controlled radio timepiece with analog display", p. 104f, Radio timepieces, R. Oldenbourg Press, 1983.

"Radio controlled timpieces", G. Krug, *Timepieces and Jewelry*, 8/171, pp. 57-59.

"Uhren durch Funk gesteurert", VDI-Nachrichten, No. 3, January 21, 1977. (Partical translation included).

*Primary Examiner*—Ulysses Weldon

*Attorney, Agent, or Firm*—Burns, Doane, Swecker & Mathis

[57] ABSTRACT

An autonomous radio controlled timepiece having a display for displaying information relative to receiving conditions to provide the consumer with increased assurance regarding the accuracy of the instantaneous time display. For this purpose, an analog or digital, optionally multidigit display element is provided, which displays supplemental information concerning the quality of reception, expressed as an indication of the period of time elapsed since the most recent monitoring and possible correction of the time display, the correction based on the information received by radio and decoded. The display element offers the lowest possible display value if the radio reception conditions are good enough that each actuation of the receiver leads to the acquisition of usable time information. The degree of certainty in the accuracy of the time display predisposes the timepiece to be used as an alarm clock in particular, in which case the alarm clock need only be equipped with setting elements for preselecting the time of alarm, for an alarm interruption or deactivation, and optionally for the switching of a supplemental display between displaying the preselected time of alarm and date information obtained from the radio information.

6 Claims, 2 Drawing Sheets

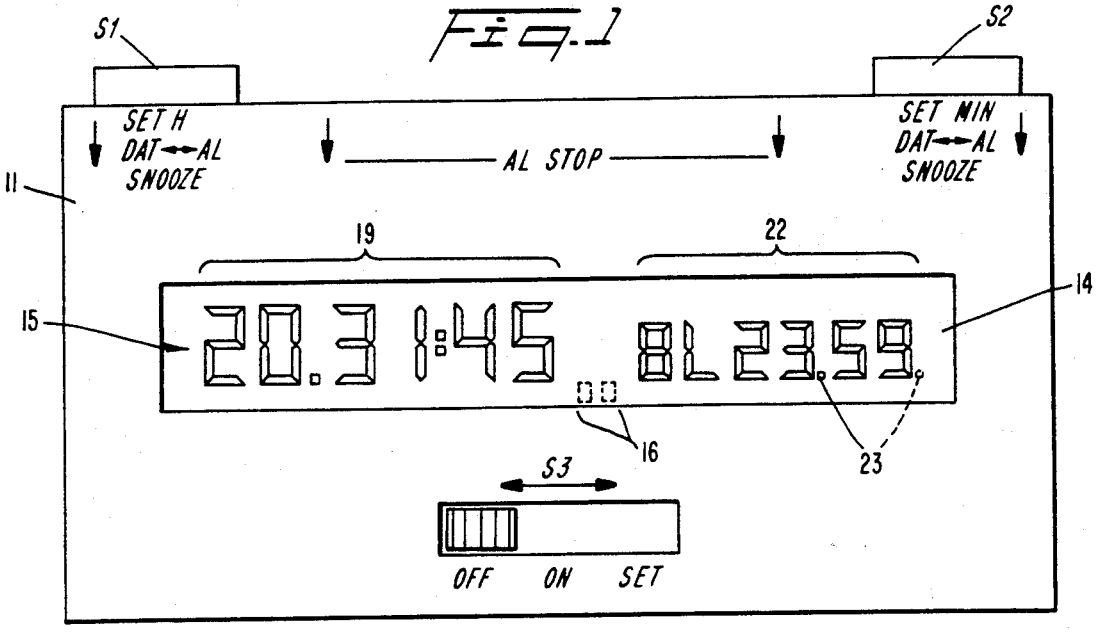
Fig. 1
S1
S2
SET H
DAT AL
SNOOZE
AL STOP
SET MIN
DAT AL
SNOOZE
11
19
22
14
15
20.3 1:45
8L23:59
16
23
S3
OFF
ON
SET
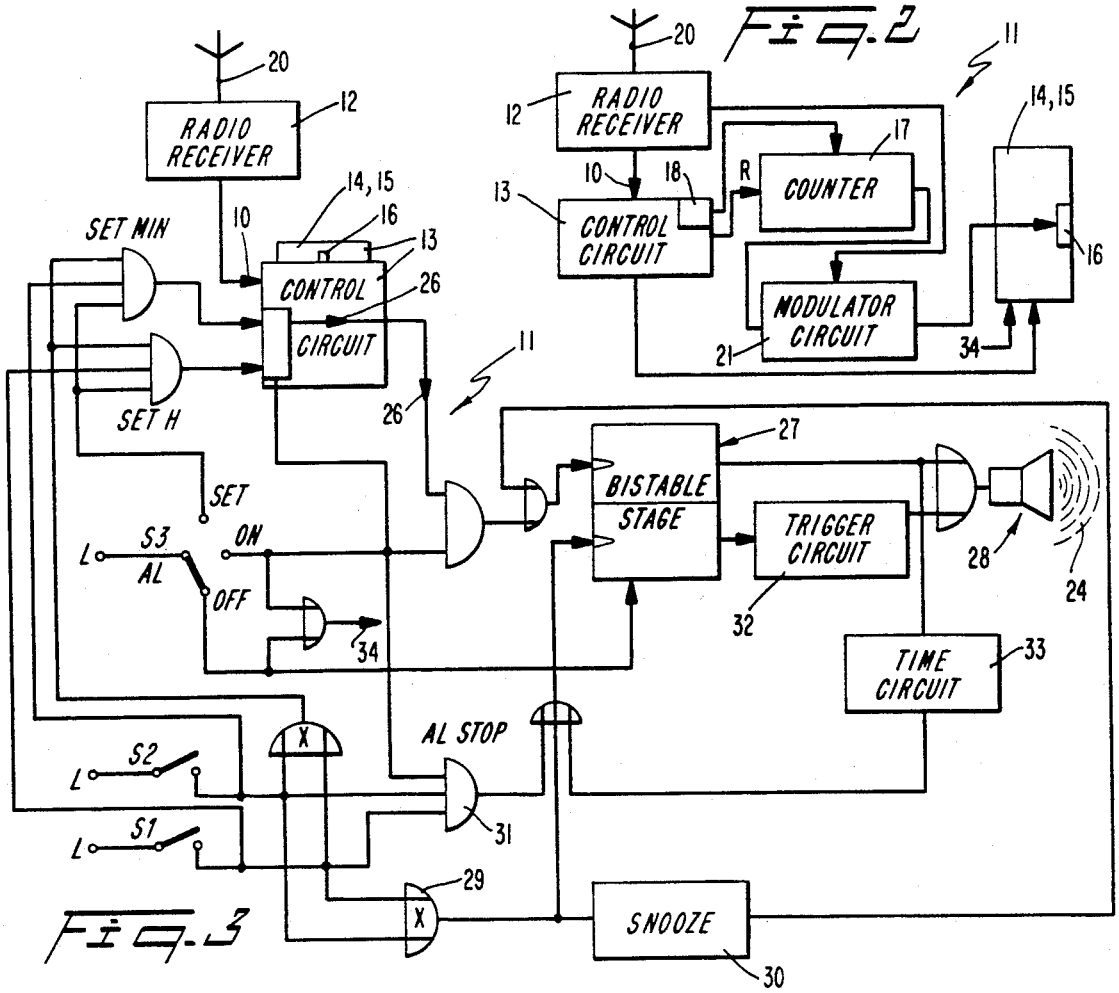
Fig. 2
20
RADIO RECEIVER
12
10
13
CONTROL CIRCUIT
18
R
COUNTER
17
MODULATOR CIRCUIT
21
14,15
16
34
11
Fig. 3
SET MIN
SET H
CONTROL CIRCUIT
26
SET
S3
L
AL
ON
OFF
BISTABLE STAGE
27
TRIGGER CIRCUIT
32
28
24
TIME CIRCUIT
33
AL STOP
31
S2
S1
29
X
SNOOZE
30

AUTONOMOUS RADIO CONTROLLED TIMEPIECE

This application is a continuation of application Ser. No. 07/248,388, filed Sept. 23, 1988 now abandoned.

BACKGROUND OF THE INVENTION

1. Field of the Invention

The invention concerns a radio controlled timepiece which displays information relating to radio receiving conditions.

2. The Prior Art

The timepiece of this type is known from DE 34 39 638 in which the display of the receiving conditions occurs by means of the drive frequency of an indicator hand, or from DE-OS 30 15 312 in which the receiving conditions are displayed as digital quality numbers resulting from the agreement of the pulses received by radio with a standard pulse form.

SUMMARY OF THE INVENTION

An object of the invention is to provide an autonomous radio controlled timepiece of the aforementioned generic type with appropriate additional uses to attain greater acceptance in the market.

This object is attained essentially by equipping a radio controlled timepiece with a display element controlled by a pulse counter which is coupled to a pulse generator. The display element is reset when valid time information is received through radio transmissions. This solution satisfies a subconscious but existing desire of consumers to receive a confirmation of the accuracy of the time display of their autonomous radio controlled timepiece by increasing the amount of information displayed concerning radio transmission receiving conditions. The displayed information conveys how long it has been since the time display of the timepiece has been corrected by means of the legal time radio broadcast and whether it would be appropriate to change the spatial orientation or the location of the radio controlled timepiece in order to obtain better radio receiving conditions.

Additionally, the fact that an actual wireless receipt of a coded time information has occurred may be displayed during the reception time, e.g., by a display that varies according to the coding frequency of the instantaneously received time information.

If the display of the receiving conditions constantly retains an optimum value, the consumer has the assurance that the periodic monitoring of the time display of his timepiece relative to the legal time transmitted by radio has been performed satisfactorily and that the time display is therefore most probably correct. For example, at each preprogrammed point in time of the monitoring, a numerical count displayed on the display element is to be advanced by one unit, and the count is reset into the initial counting state upon each receipt of valid time information. The lowest value is displayed during the initial counting state and the time information obtained at each predetermined monitoring time ensures that the time display was actually verified (and corrected if necessary).

This assurance of the operation and correct time display of the timepiece is of interest when the timepiece is in the form of an alarm clock, such as those known from DE-OS 35 10 636. In this case, the display of receiving conditions is conveniently included in the representation of the prevailing time and the predetermined alarm time, wherein said display may consist of an analog display, but preferably consists of a digital display. In order to be able to convey the date information contained in the radio time information without an excessive display size, an additional display is switched between the alarm time indication and date indication (at least the day and month). It is known from other technologies, such as digital wrist watches, for example, to provide the manual alteration of the display. Separate pushbutton switches are provided appropriately for the advance of the hour display and of the minute display. In the present case these pushbutton switches are used only to change the alarm time displayed and thus do not affect the instantaneous time or date displayed (as these displays are now verified by means of the time information received by radio (and corrected, if necessary)). On the other hand, it is convenient to use these two switches provided for manual display correction, to interrupt or terminate an alarm signal or to switch the additional display (alarm time-date), depending on the position of an operating mode change-over switch. It is particularly convenient for operating reasons to use one of the two existing push button switches to actuate display switching or (depending on the position of the operating mode change-over switch) for a mere interruption of the alarm signal (so-called SNOOZE or repeating signal). In the alarm operation, the final discontinuation of the alarm signal (until the next alarm time setting is attained) takes place only if both existing push button switches are actuated simultaneously, and is confirmed by an acoustic feedback to assure the operator of the alarm status.

Additional alternatives and further developments and characteristics and advantages of the invention will become apparent from the dependent claims, with consideration of the abstract, and from the description below of an example embodiment illustrated in the drawing which is restricted to the essential information and described in an abstract manner, of the solution according to the invention.

BRIEF DESCRIPTION OF THE DRAWINGS

In the drawings:

FIG. 1 shows an autonomous radio controlled timepiece in the form of a date or alarm clock, with a digital display, FIG. 2 is a simplified, single pole block circuit diagram for obtaining the instantaneous display information concerning receiving conditions, FIG. 3 is a simplified single pole block circuit diagram which operates as a function of an operating mode change-over switch and as a function of two push button switches to affect the time of the alarm and of the alarm signal (without consideration of the additional display switch-over possibilities using the same switches such as between the prevailing date and the predetermined alarm release time)

DETAILED DESCRIPTION OF THE PREFERRED EMBODIMENT

Figure 4:
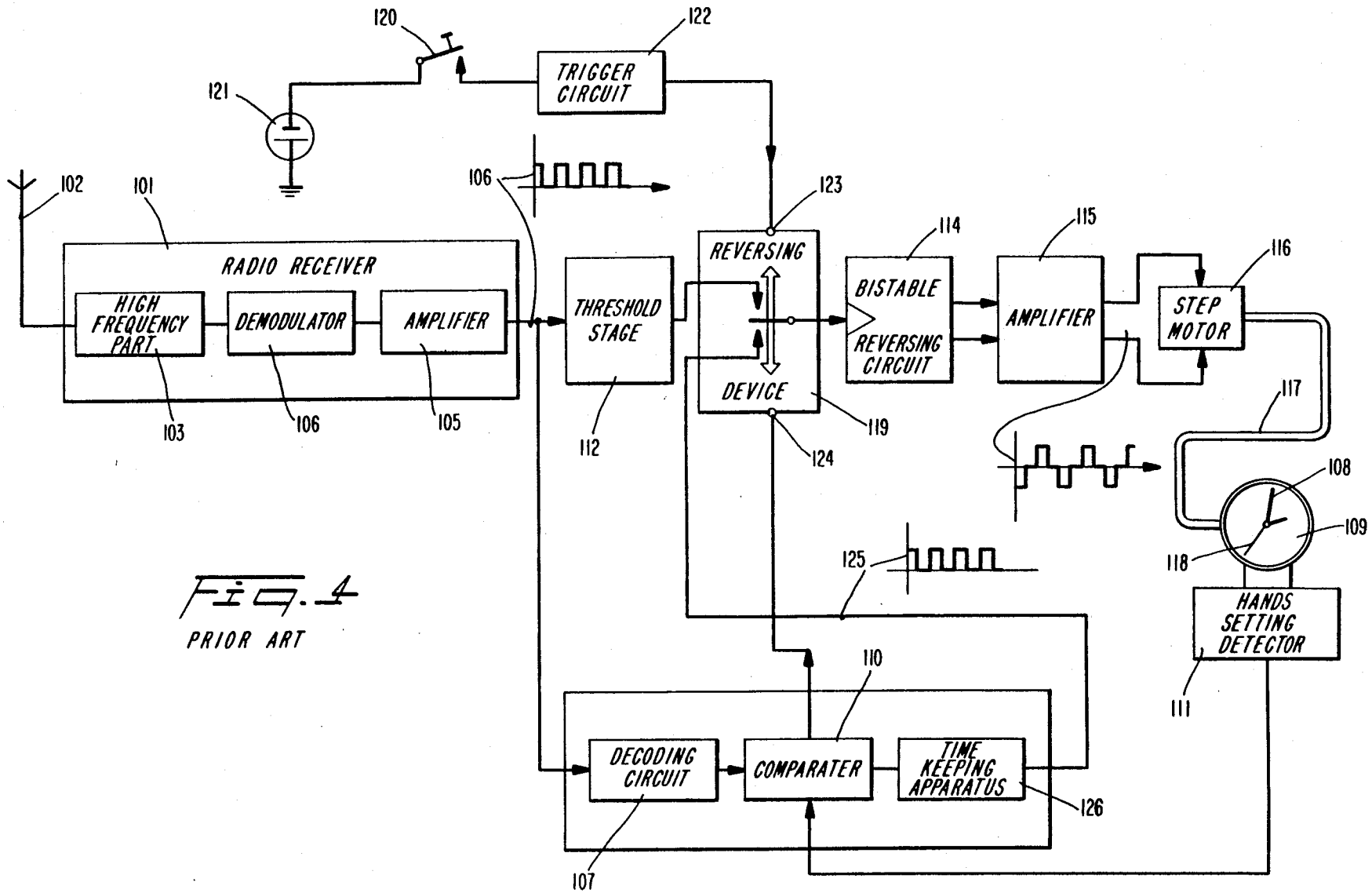
FIG. 4 PRIOR ART
FIG. 4 illustrates an autonomous radio controlled timepiece according to the prior art.

The autonomous radio controlled timepiece 11 consists of a radio receiver 12 and a control circuit 13 to monitor and correct, if necessary, the instantaneous time display in keeping with the instantaneous time information 10 transmitted by a standard time sender, and to provide subsequent internal time keeping operations until the next time information is received, such as described for example in DE 34 39 638 in more detail, which discloses an autonomous radio timepiece as shown in FIG. 4. This radio timepiece includes a radio receiver 101 and a time display device designed to clearly indicate whether the prevailing radio receiving conditions could lead to correction of a potentially incorrect time display without extensive additional efforts relative to the time display. For this purpose, the operation the stepping progress of a hand (for example, the seconds hand 118) is derived from a demodulated pulse sequence 106 containing a decoded time information, and switched to a sequence of internally obtained time keeping pulses 125 if a decoding circuit 107 was able to decode complete time information.

Following the activation of the radio timepiece, it is therefore clearly recognizable from the stepping progress of the indicator hand (108 or 118) deviating from the seconds rhythm that inadequate radio receiving conditions are exist. The receiving conditions may be improved (for example by changing the local orientation of the radio timepiece) until the progress of the indicator hand (108, 118) is in seconds.

FIG. 4 further shows an autonomous radio timepiece having an internal timekeeping apparatus 126 with an analog time display, a decoding device for decoding coded time information received by radio, and a receiving function indicator, the indicator setting of which is corrected in keeping with the decoded time information.

A radio timepiece of this common type is known from the article by H. Effenberger (Institute for Timepiece Technology and Precision Mechanics, Stuttgart University) entitled "Microprocessor controlled radio timepiece with analog display", page 104f of the book *Radio timepieces* edited by W. Hilberg (R. Oldenbourg Press, 1983), and particularly the display 12 relative to FIG. 1 in combination with the second paragraph of page 107 and page 108, bottom. In this timepiece, specific measures are carried out by a microprocessor program in case of receiving problems and a light emitting diode built into the timepiece is simultaneously actuated emit a blocking signal to be interpreted as an indication of the reception problem.

DE-OS 30 15 312 discloses a radio timepiece with a digital display whereby it is possible to carry out an electronic comparison of the receiving pulses containing coded time information with numerically defined standard pulses and to derive therefrom a digital indication relative to the quality of the demodulated receiving pulses, i.e., coded information concerning the instantaneous receiving conditions. Such a digital evaluation of the receiving conditions based on a comparison of pulse forms may be of scientific interest, but for a daily user of a utility timepiece information derived in this manner has no particular significance.

A radio timepiece of FIG. 4 is defined as the operative combination of a radio receiver and an autonomously operating timepiece equipped with a time keeping electronic circuit, wherein at certain intervals, the instanteous time display is compared with an actual point in time transmitted by a radio in coded form and corrected in case of deviations.

On the other hand, the time piece of FIG. 4 does not concern another common type of timepiece such as disclosed in the article "Radio controlled timepieces" by G. Krug in *Timepieces and Jewelry*, 8/1971, pages 57–59. The Krug article discloses that a secondary timepiece network is stepped forward from a central source of pulses, whereby the stepping pulses are not transmitted completely by the line network but over longer distance wire-less communications, i.e., by radio. The radio information contains no absolute time information, with the consequence that step displays cannot be changed by means of the radio information from an arbitrary false display setting into a correct setting corresponding to the instantaneous point in time. In the timepiece system described above, designed for trade fair exhibition, with stepping mechanism actuating pulses transmitted by radio, an acoustic indication of the individual decoded stepping pulses is provided, which would be entirely inappropriate for a consumer timepiece in view of the unbearable physiological impact on the environment.

Particularly, in the case of a timepiece equipped as a radio timepiece of this common type and which, as a consumer timepiece, may be used in many different locations depending on the instantaneous and changing installation conditions, there may exist a problem relative to the operating technology in that, as a function of the prevailing local conditions and the instantaneous effects of the environment, the reception of the time information in the coded form may be interfered with or even prevented. This has only a small effect to the extent that, as a result the decoding of the instantaneous time information and its comparison with the instantaneous time, display of the timepiece could possibly not take place at the intended point in time and is postponed until there are more favorable receiving conditions present. However, it represents a serious interference if the radio timepiece is located in such an unfavorable place that no valuable reception information may be obtained at all and that therefore, for example upon the actuation of the timepiece, no incorrect display can be corrected to indicate the actual correct point in time.

In view of these conditions, it is the object of the timepiece of FIG. 4 to provide a radio timepiece of a common type so that as a conventional analog timepiece it will provide information about whether instantaneous decoding of time information transmitted by radio in a coded form is interfered with or is regular (and therefore leading to a correction of a possibly incorrect indicator setting) in a form readily apparent even to those not skilled in the art.

The object of the timepiece shown in FIG. 4 is attained essentially by a radio timepiece including an indicator hand revolving in a stepping mode wherein the actuating signals whereof are obtained from the seconds cycle of the time information received.

With this solution no intellectual effort is required for the interpretation of a special electro-optical display, such as for example "synchronization blocked," or for a quantitative comparative evaluation of the quality of demodulated receiving pulse forms. Instead, a hand serving as a time indicator is moved forward by the pulse sequence received and carrying the coded instantaneous time information (appearing regularly in the seconds grid with the suppression of each 59th second of a full minute), i.e., in the conventional rhythmic seconds sequence, in the case of undisturbed receiving conditions at the location of an operational radio timepiece.

This indicator stepping movement of the timepiece shown in FIG. 4, which clearly indicates the reception of discrete pulses in the seconds grid involved, may be readily interpreted, if necessary, even by those not skilled in the art, to recognize that the radio timepiece apparently is operating regularly. Such a person will thus understand that the time display, in case of a deviation from the instantaneous time, will be set to the correct time during the next comparison point in time. If, on the other hand, the reception of the coded time information is disturbed, then either certain pulses are missed, or pulses appear in a rapid or irregular sequence relative to seconds cycle. Both of these conditions lead to an unusual movement of the indicator in deviation from the seconds sequence.

In any case, it is readily apparent even to those without skills in the art from an irregular indicator movement on the timepiece of FIG. 4, that the instantaneous time display is not secured and that it will not be corrected within a foreseeable period of time. An attempt can then be made to improve receiving conditions by changing the location of the radio timepiece, for example.

It is particularly appropriate to carry out this application of the demodulated receiving pulses to the indexing of the indicator hand only at the beginning of the operation and to switch to the internal time keeping circuit as soon as a first complete time information is decoded and made available for time comparison and possibly for display correction. If at this time regular demodulated pulses arriving in the seconds cycle are already present and the seconds hand of a timepiece is chosen as the reception indicator, the user possibly will not even notice the switch of the indexing of the indicator hand (with the exception of the missing 59th pulse) from the demodulated receiving pulses to the (uninterrupted) second cycle of the time keeping circuit; he will therefore not be unnecessarily irritated by it.

If, on the other hand, more explicit information of this switching process under undisturbed receiving conditions is desired, it is convenient to choose an indicator hand that normally is not moved in the seconds cycle (i.e., for example the minute or hour hand of the timepiece) which is actuated by its own motor.

The switch of the actuation of the hands step motor from the demodulated receiving pulses to the time keeping device may be carried advantageously—especially if the decoding of the time information and the determination and correction of the time display is effected by means of a microprocessor—in a circuitry combination including a decoding circuit and comparison of the time information transmitted in the coded form by radio.

The prior art will become more apparent from the description hereafter of the exemplary embodiment shown in a simplified manner in FIG. 4 in the form of a block circuit diagram showing the essential elements.

In the radio timepiece of FIG. 4, a radio receiver 101 including a high frequency part 103, an antenna 102 (for example a ferrite rod coil), a demodulator 104 and an output amplifier 105, is supplied with a rectangular pulse sequence 106 having a pulse sequence frequency of 1 Hz which, by means of binary pulse coding, carries complete time and date information (not shown in detail in the FIG. 4) within one minute.

If an undisturbed pulse sequence 106 has been received over at least one complete minute, the information relative to the instantaneous point in time may be detected by means of a decoding circuit 107 and compared with the instantaneous time display provided by a hands setting detector 111 in a comparator 110. The time display is in the form of the setting of the hands 108 in front of the minute mechanism on the face 109 of a time piece. The hands setting detector 111 is based for example on rotation angle measurements or incremental step transducers.

The pulse sequence passing through a threshold stage 112 (in the example shown with their differentially positive flanks) actuates the dynamic switch inlet 113 of a bistable reversing circuit 114. The switch inlet 113 is actuated at the mutually inverted outlets of the bistable reversing circuit 114 therefore in the rhythm of the pulse sequence 106 alternating H potentials and L potentials. It may be convenient to connect an amplifier 115 after said outlets, which may also be components of a pole reversing bridge circuit.

In any case, the signal sequence leading to the succession of rotating steps by one-half of a revolution and consequently by means of a drive clutch 117 to the stepping movement of a hand (here the seconds hand 118) by a one second step, is thus applied alternatingly to a bipolar single-phase control coil of a timepiece step motor placed over the outlets of the bistable circuit 114 and the amplifier 115, if the pulse sequence 106 supplied by the radio receiver 101 is undisturbed, i.e., is present in the seconds grid with a pulse sequence frequency.

If, on the other hand, the pulse sequence 106 is disturbed (in the form of missing or interrupted individual pulses), this is immediately apparent from the motion of the indicator hand (here the seconds hand 118), which does not display the usual uniform step movement, but jumps in a unruly manner, for example.

A reversing device 119 is preferably provided for the actuation of the step motor 116, by which—as described above—the pulse sequence 106 is conducted from the radio receiver 101 to the reversing circuit 114, whenever the overall apparatus, or at least the receiver 101 is activated following a pause. For example, the activation may be by means of an operating switch 120 or because of the actuation of a power source (for example a battery). In this manner, a setting inlet 123 of the reversing device 119 is actuated, possibly through a trigger circuit 122 to actuate a setting pulse, for the transmission of the pulse sequence 106 to the reversing circuit 114.

At the onset of the operation of the timepiece of FIG. 4 therefore the progress of the indicator hand 118 displays the actual passage of time in the seconds grid only if an undisturbed pulse sequence 106 is being received. As soon as the decoding circuit 107 has decoded the time information from said pulse sequence, the reversing device 119 is switched by means of its reset inlet 124 to the reception of the time keeping pulses 125 from a time keeping apparatus 126, i.e., to a timepiece seconds cycle, in which from here on for example a seconds hand 118 is moved (until the next interruption of the operation of the radio timepiece). However, the time keeping pulses may also be temporarily have a higher frequency, if the comparator 110 detects a deviation between the time displayed by the hand 108 and the instantaneous time decoded by the decoding circuit 107.

For the sake of clarity, FIG. 4 does not indicate that it may be convenient to provide separately actuated step motors 116 for the seconds hand 118 and the hour and minutes hand 108 and to activate them separately from the comparator 110, in order to make possible the rapid adjustment of the setting of the hour and minutes hand 108, without having to rotate the seconds hand 118 also (at an inappropriate rapid rate by means of an operating clutch). Such separate motors 116 make it possible to further select as the reception indicator hand the minutes or even the hour hand 108; in this case the function of the reversing device 119 would also include the separation of the indicator motor 116 from the receiving pulse sequence 106 and the switching of the time keeping pulse sequence to the timepiece drive circuit. The display of the time information, according to the exemplary embodiment, is not an analog hand display, but a digital indication with a display 14 of grouped digits 15. At least one display element 16, is shown to consist of two digits which, in the exemplary embodiment, serve to display information relative to the prevailing receiving conditions. For this purpose, a counter 17 is connected to a pulse generator 18 (which may consist of the internal time keeping circuit for the autonomous operation of the timepiece) provided in connection with the control circuit 13 for counting pulses. Information proportional to the result of the counting are indicated by means of the display element 16. Whenever the control circuit 13 receives valid instantaneous time information 10 by means of the receiver 12 for comparison with the instantaneous time display 19 (and possibly to correct the instantaneous time display 19), the reset port R of the counter 17 is actuated by the control circuit 13 for resetting the counter to an initial state. The display element 16 indicating the receiving conditions shows an information value in the form of digits which increase with the time elapsed since the last monitoring of the time display. The longer the elapsed time is, the proportionally less assured the agreement between the instantaneous time indication and the prevailing time becomes. Therefore, according to the preferred embodiment, if the initial counting position of the counter 17 is at ZERO value, and a counting pulse is transmitted hourly to the counter 17 and an hourly comparison is made between the prevailing time display 19 with the time information 10 received by radio, the two-digit digital display element 16 is always maintained at "00". If, however, the display increases its hourly count, this signifies that receiving conditions at the location of the radio timepiece 11 are so poor that no received transmissions are decodable, and that no valid time information has been possible to decode over the number of hours indicated and therefore the instantaneous time display 19 is unassured (not verified for an extensive period of time); whereupon the radio timepiece 11 should be placed as soon as possible into a different location or environment in which the built-in antenna of the radio timepiece is capable of undisturbed radio reception to thereby receive valuable time information 10.

Additionally, the display element 16 may provide a signal when the radio timepiece is switched to receive the prevailing time information for the control of the instantaneous time display 19. This may be effected for example by means of a modulator circuit 21, actuated by the receiver 12 in the seconds frequency of the time information coding, thereby leading to the flashing in seconds of at least one of the digits 15 of the display element 16.

If the display 14 comprises, in addition to the time display 19, a supplemental display 22, the display element 16 associated with the receiving conditions is appropriately located in the center of the display 14 between two displays 19 and 22 and thus have a subdued order of magnitude relative to the other conspicuous elements, as shown in FIG. 1. The supplemental display 22 may represent date information also transmitted by radio and, during autonomous operation, may be derived from the flow of time. The date information may be displayed, for example, by two pairs of numerical digits 15, each followed by a period 23. Instead or alternatively, the supplemental display 22 may also consist of an alarm indicator, comprising the two numerical digit pairs 23 preceded by letter digits 15 "AL" (FIG. 1). Thus, if the radio timepiece 11 is equipped as a timer or alarm clock, the AL display 22 indicates the manually set point in time at which an alarm signal will be emitted.

While the setting of the time display 19 and the supplemental date display 22 is carried out automatically upon the receipt of radio transmitted time information 10 by means of the control circuit 13, the setting of the time of the alarm requires a manual operation. For this, an operation mode changeover switch S3 is brought into the SET position, whereupon the digit pair indicating the hours or minutes is changed stepwise by means of the push button switches S1 and S2, for example, advanced in accordance with the manual switch actuation.

If the operation mode changeover switch is not in the SET position, the actuation of one of the push button switches S1 and S2 switches the supplemental display 22 between the alarm time set (FIG. 1) and the date. In this process, the instantaneous display 22 may be maintained until the next push button actuation, or automatically returned to a preferred display 22 by means of circuitry.

In the ON setting of the operation mode changeover switch S3 a coincidence stage 25 is activated, which in case of the coincidence of the preset alarm time with the prevailing time, actuates, by means of a coincidence signal 26, a bistable stage 27 of an alarm emitter 28 (for example a piezoelectric transducer) for the emission of an alarm signal 24.

If either one, but only one of the push buttons S1 or S2 is actuated, the trigger circuit 27 is reset by means of an exclusive-OR-gate 29 and a monostable trigger circuit 30 is started in order to reset the bistable stage 27 to induce emission of an alarm signal after a certain predetermined pause (SNOOZE-alarm repetition function). If both push button switches S1 and S2 are actuated simultaneously (i.e., with time overlap), the response is not by the exclusive-OR-gate 29, but by an AND gate 31 connected to the switches S1 and S2, whereby the signal emission stage 27 is reset to discontinue the alarm signal. If, at that instant no alarm signal 24 was being emitted, at least a very brief confirmation signal emission is triggered by means of a trigger circuit 32 (optionally unique in frequency or modulation), which represents an acoustic acknowledgment of the overlapping actuation of the two push button switches S1 and S2. This "AL STOP" actuation further insures that an alarm signal is again emitted only when a coincidence is again attained in the time display between the instantaneous setting display 22 and the actual time display 19 (e.g., 24 hours).

A timer circuit 33 started when the alarm transducer stage 27 is in the set position, serves to automatically terminate the emission of the alarm signal 24 after a certain period of time provided no manual interruption or termination is executed by means of the push buttons S1 and S2, in order to prevent a continuing disturbance or an unnecessary load on a source of energy (e.g., a battery) of the radio timepiece 11.

In the OFF position of the operation mode changeover switch S3, the bistable alarm transducer stage 27 is conveniently rigidly locked in the reset position, so that no alarm release could occur by means of the coincidence stage 25.

The gate circuit shown in FIG. 3 further insures that only in the SET position of the operation mode changeover switch S3 could one (and instantaneously only one) of the push buttons S1 and S2 be actuated to modify the alarm time setting to the coincidence stage 25; while in the two other positions of S3 (ON or OFF) a signal 34 is generated, which permits the information display of the supplemental display 22 to switch (date-alarm timing) upon the actuation of one of the push buttons S1, S2. For the sake of clarity, this is not shown in the circuitry in FIG. 3.

In the example of the embodiment depicted in the drawings, the gate circuit and the effects of the monostable and bistable trigger stages are conveniently not illustrated by a discrete circuit layout, but are depicted as supplemental functions of a central processor, which is contained in the control circuit 13. The control circuit 13 provides the periodic actuation of the receiver 12, the decoding of the absolute time information 10 received by radio and, if necessary, the correction of the time and date displays 19, 22.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that came within the meaning and range of equivalents thereof are intended to be embraced therein.

What is claimed is:

1. An autonomous radio controlled timepiece comprising:

radio signal receiving means for receiving radio transmissions of coded time data;

a control circuit connected to said radio signal receiving means for decoding the received time data into valid time data;

a pulse generator connected to said control circuit for generating pulses;

a counter connected to said pulse generator for storing the number of pulses generated by said pulse generator;

reset means coupled to said control circuit and said counter for resetting said counter upon the decoding of the valid time data by said control circuit; and display elements coupled to said counter for displaying a number proportional to the number stored in said counter whereby the number displayed by said display elements is indicative of the time period which has passed since valid time data was decoded.

2. The timepiece of claim 1, wherein:

said display elements include separate digits in a display.

3. The timepiece of claim 1, further comprising:

modulation circuit means connected to said display, said counter and said radio signal receiving means for flashing at least one of said display elements.

4. The timepiece of claim 1, wherein:

said display elements are located on a digital display which displays time information and supplemental information.

5. The timepiece of claim 1, further comprising:

alarm transducer means coupled to said control circuit for providing an alarm signal; and manually adjustable coincidence stage means coupled to said alarm transducer means and said control circuit for actuating said alarm transducer means.

6. The timepiece of claim 5, further comprising:

means, coupled to said control circuit and said alarm transducer means, for blocking the emission of said alarm signal until the next coincidence of actual time and a preset alarm time upon manual operation of said first and second switches; and means, coupled to said means for blocking and said alarm transducer, for triggering a confirmation signal when blocking the emission of said alarm transducer means upon manual operation of said first and said second switches.

* * * * *